US005393173A

United States Patent [19]

Morello

[11] Patent Number: 5,393,173

[45] Date of Patent: Feb. 28, 1995

[54] TUNNEL LINER BUILDING METHOD AND BUILDING PANELS THEREFOR

[75] Inventor: Frederick Morello, Johnston, Pa.

[73] Assignee: M.I.C. Industries, Inc., Reston, Va.

[21] Appl. No.: 916,379

[22] Filed: Jul. 22, 1992

[51] Int. Cl.[6] ..... E21D 11/24

[52] U.S. Cl. ..... 405/151; 52/86; 52/528; 52/529

[58] Field of Search ..... 52/86, 87, 528, 529, 52/588, 594; 405/151 OR, 126

[56] References Cited

U.S. PATENT DOCUMENTS

| | | | |
|---|---|---|---|
| 2,718,117 | 9/1955 | Boyle et al. | 405/126 |
| 3,638,434 | 2/1972 | Delaere | 405/126 |
| 3,842,647 | 10/1974 | Knudson . | |
| 3,902,288 | 9/1975 | Knudson . | |
| 3,967,430 | 7/1976 | Knudson . | |
| 4,213,282 | 7/1980 | Heckelsberg | 52/528 |
| 4,224,775 | 9/1980 | Heckelsberg | 52/528 |
| 4,364,253 | 12/1982 | Knudson | 72/187 |
| 4,439,065 | 3/1984 | Constapel | 405/151 |
| 4,580,384 | 4/1986 | Hutcheson | 52/528 |
| 4,650,369 | 3/1987 | Thomas et al. | 405/126 |
| 4,694,628 | 9/1987 | Vondergoltz et al. | 52/528 |
| 4,759,159 | 7/1988 | Blazley | 52/86 |
| 4,819,398 | 4/1989 | Dameron | 52/594 |
| 5,022,207 | 6/1991 | Hartnett | 52/528 |
| 5,046,893 | 9/1991 | Borgnini | 405/151 |

FOREIGN PATENT DOCUMENTS

| | | | |
|---|---|---|---|
| 2-125049 | 5/1990 | Japan | 52/528 |
| 2244072 | 4/1991 | United Kingdom | 405/151 |

*Primary Examiner*—Carl D. Friedman
*Assistant Examiner*—Wynn E. Wood
*Attorney, Agent, or Firm*—Rothwell, Figg, Ernst & Kurz

[57] ABSTRACT

Tunnel liners are formed from panels of arched, bendable sheet material. The panels include a central portion, inclined side portions, wing portions, and hook and receptacle portions on opposite sides of each panel. Panels are joined with the hook portion of one panel fitting into the receptacle portion of the other panel and are then continuously seamed from the underside, i.e., the inside of the arched assembly.

8 Claims, 6 Drawing Sheets

TUNNEL LINER BUILDING METHOD AND BUILDING PANELS THEREFOR

FIELD OF THE INVENTION

This invention relates to the art of forming tunnel liners and particularly to improvements for forming such tunnel liners of panels of arched bendable sheetmetal material, and includes a unique method of building such tunnel liners and unique panels and assemblies of panels.

BACKGROUND AND PRIOR ART

Machines which form bendable materials, such as sheetmetal, into panels and curve the panels for making continuous arched buildings or roofs for buildings by seaming the panels together are known in the art. Such machines are commercially available from M.I.C. Industries, Inc. of Reston, Va. and are shown, at least partially, in U.S. Pat. Nos. 3,842,647, 3,902,288, 3,967,430 and 4,364,253, all owned by M.I.C. Industries, Inc. In this prior art, the panels formed from the sheet steel or the like are used with a seaming apparatus which operates from the top of the structure to seam adjacent panels and secure these panels together.

A problem exists with the prior art described above when attempting to construct a structure within a closed space, such as a lining for a tunnel, or when a distance between the top of the panels and the existing structure is so limited that seaming cannot be accomplished.

SUMMARY OF THE INVENTION

This invention relates to a tunnel liner structure, panel and building method in which curved continuous arched panels of bendable sheetmetal material are seamed together from the underside of the structure. The individual panels have a central main portion, a pair of inclined side wall portions, one on each side of the main portion, and extending at an inclined angle to the main portion. Extending from each of the inclined side wall portions are wing portions which are generally parallel to the main portion. On one side of each panel is a hook portion which extends from one wing and on the other side of each panel there is a receptacle portion extending from the end of the other wing. The receptacle portion includes an edge portion at its end. In this manner, assembling the panels side-by-side and bending the edge down onto the hook provides for a continuous seam between adjacent panels, which seam can be made from the underside of the panel.

The invention also comprises a method of forming tunnel liners by making arched continuously curved-shaped panels of bendable sheet material, in situ, the panels being the shape as described above. Several plurality of the panels are assembled together on the ground with the hook side of one panel adjacent the receptacle side of the adjacent panel, then the panels are seamed together and erected. After erecting sets of seamed panels, the sets themselves are seamed together, all seaming being done from the underside by a roll-type seamer.

DETAILED DESCRIPTION OF PREFERRED EMBODIMENT

Figure 1:
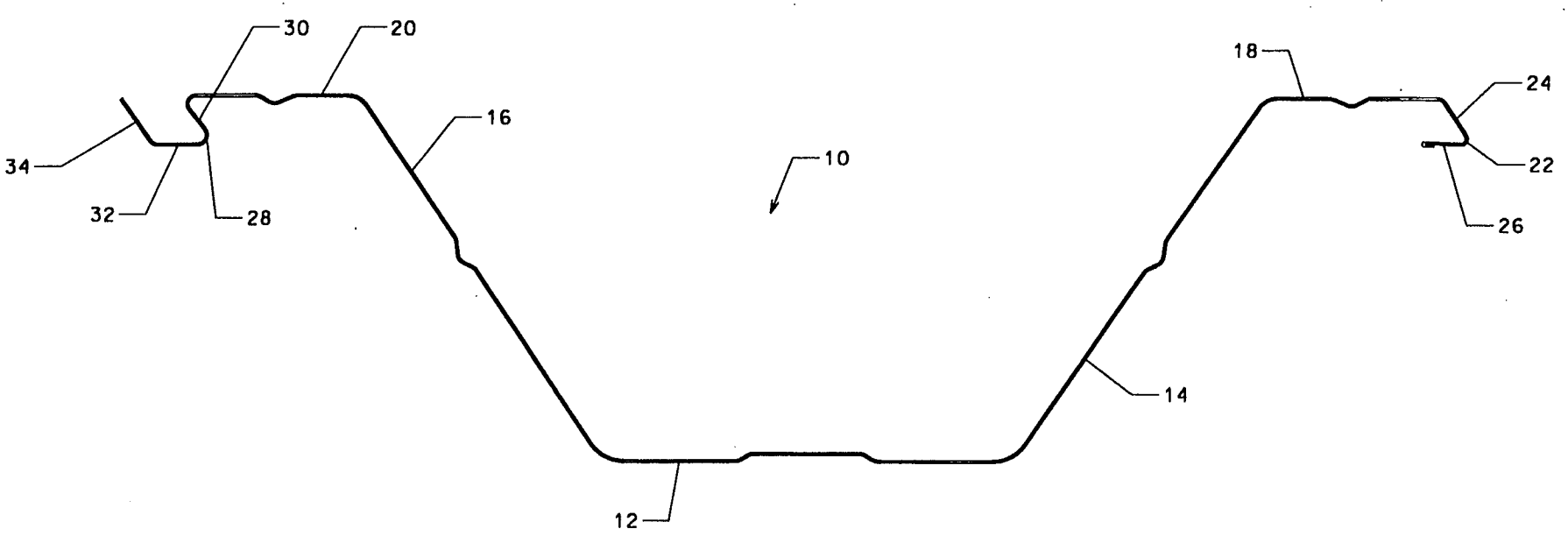
FIG. 1 is a cross-sectional view of a preferred form of the tunnel liner panel of this invention.

A panel 10, shown in FIG. 1, is formed and continuously curved to provide an arched-shaped panel of which FIG. 1 is a cross section. The panel 10 has a main central portion 12 off of which a pair of inclined side portions 14 and 16 extend at an inclined angle. Wing portions 18 and 20 extend from outer ends of the inclined side portions in a generally horizontal fashion parallel to the main central portion 1. At the end of wing portion 18 is a hook portion 22 which includes an inclined hook section 24 and an end hook section 26. The hook section 26 is parallel to the wing and the main central portions.

The end of other wing 20 has a complementary receptacle portion 28 for receiving the hook portion 22. The receptacle portion includes an inclined section 30 which is parallel to inclined section 24 and of the same length. An intermediate section 32 is parallel to end section 26 of the hook. The end section 26 of the hook fits into intermediate section 32 and inclined section 30 of the receptacle receives the inclined section 24 of the hook. The receptacle portion 28 terminates with an upstanding edge section 34.

For forming the panels automatically and on site, there is a mobile machine 44 which is mounted on a trailer 46 and has its components powered from an engine 48. As is known in the art, a coil of steel 50 is placed on a machine and runs through a forming section 52 to form the panel. In the present instance, the panel is formed to the shape illustrated in FIG. 1. A run-out table 54 is provided for receiving the formed panel and after the desired length of panel is formed, it is cut off by a guillotine shear on the machine (not shown). The formed panel is then turned sideways on the run-out table and fed back through a curving station 58, which curves the formed panel by forming crimps in the main central portion 12. A run-out table 60 receives the curved formed panel 62. In general, such a mobile machine for forming and bending sheetmetal into formed, curved panels is commercially available from M.I.C. Industries, Inc. of Reston, Va.

Figure 5:
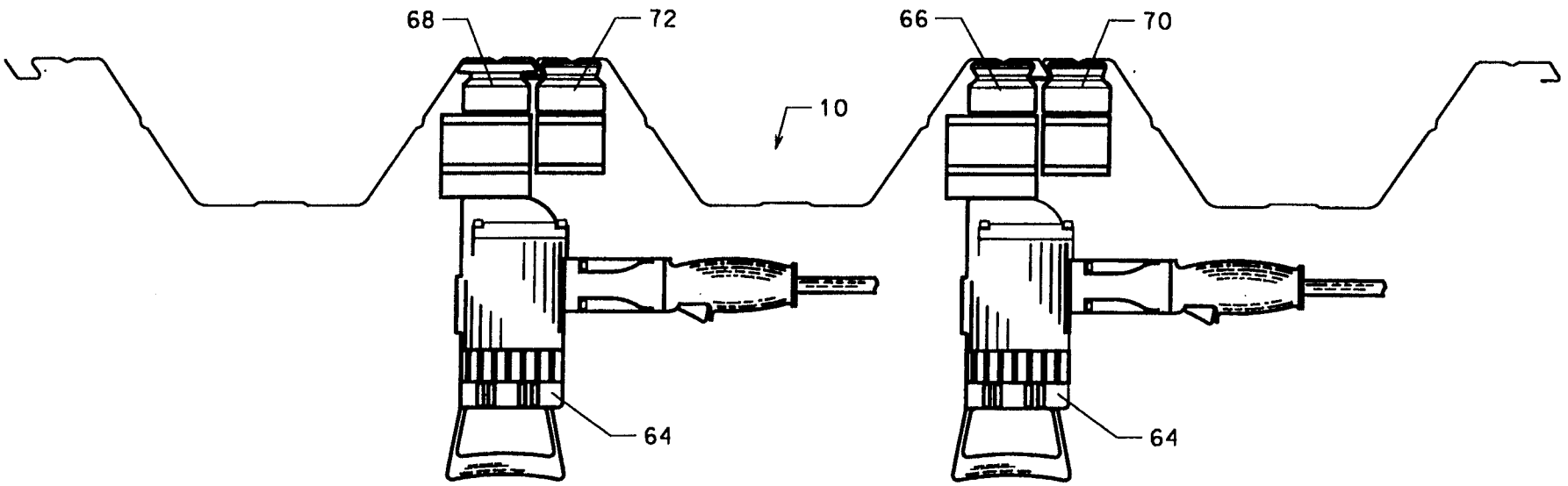
FIG. 5 is an elevational view illustrating the seaming of adjacent panels according to this invention.

The adjacent panels may be seamed together using a seaming means, as shown in FIG. 5. A seamer 64 may be of the type generally known for seaming metal panels and includes four seaming rollers. As shown in the right-hand portion of FIG. 5, there is a drive roller 66 and a corresponding backup idler roller 70. Drive roller 66 is for initially bending the edge portion. In the direction of travel of the seamer 64, the seamer has two other rollers, namely, drive roller 68, backup roller 72. Drive roller 68 is for flattening the edge portion over the hook end section to complete the seam.

Figure 6:
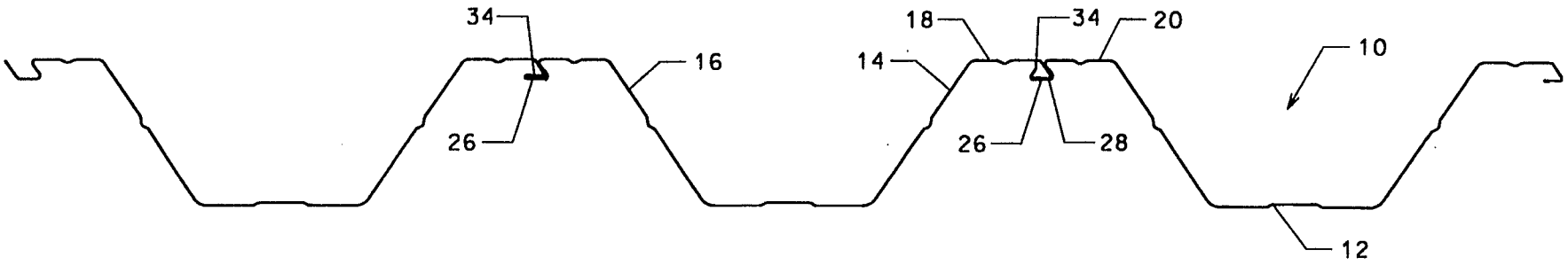
FIG. 6 is a cross-sectional view of three panels illustrating the seaming stages.

FIG. 6 shows three panels, side-by-side and the seam between the panels, on the right-hand side of the figure, illustrates the condition at the time the rollers 66 and 70 bend the edge portion over toward the hook end. The left end seam in FIG. 6 shows the final section of the seaming after rollers 68 flattens the edge portion onto the hook portion.

The seamer 64 can be run continuously from one side of the arched panel to the other on the underside of the curved panel, i.e., inside a tunnel. This has particular advantage in situations where access to the top of a tunnel liner is impossible.

Figure 2:
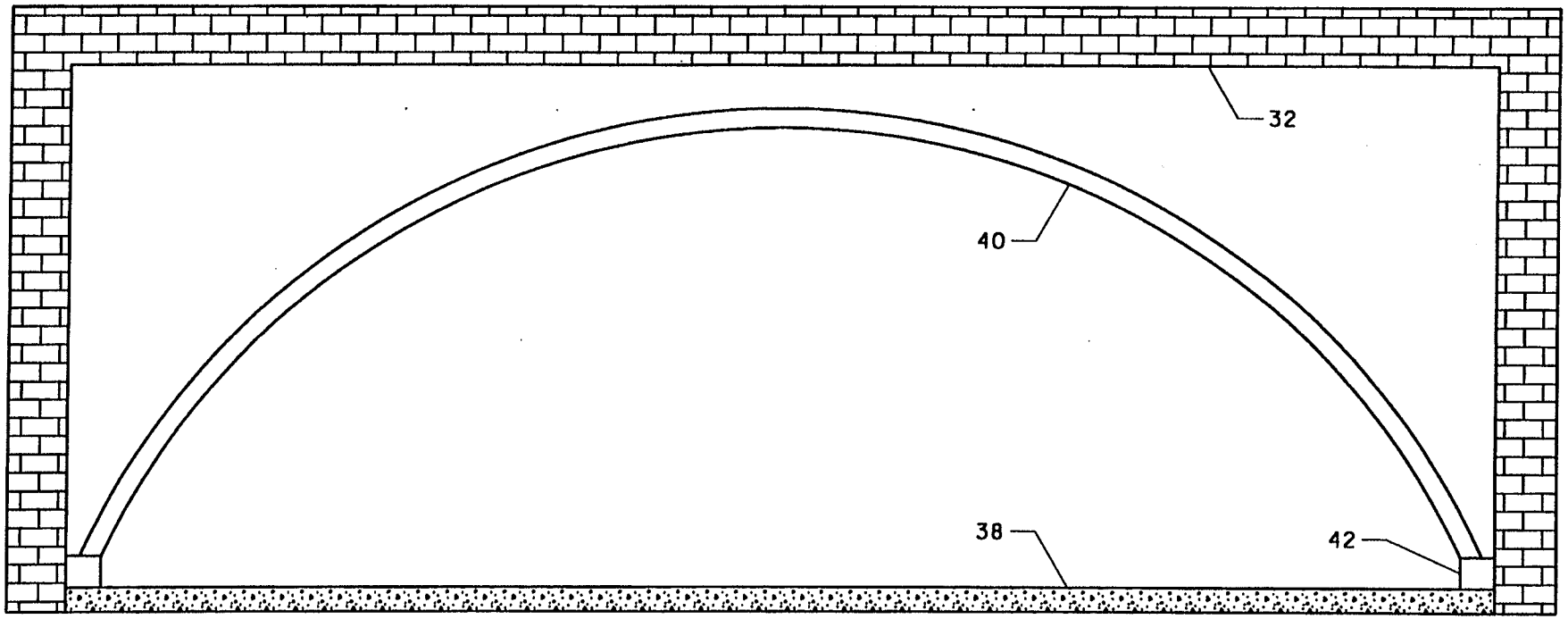
FIG. 2 is an end view illustrating the use of tunnel liners of this invention in lining a tunnel of rectangular section.
Figure 3:
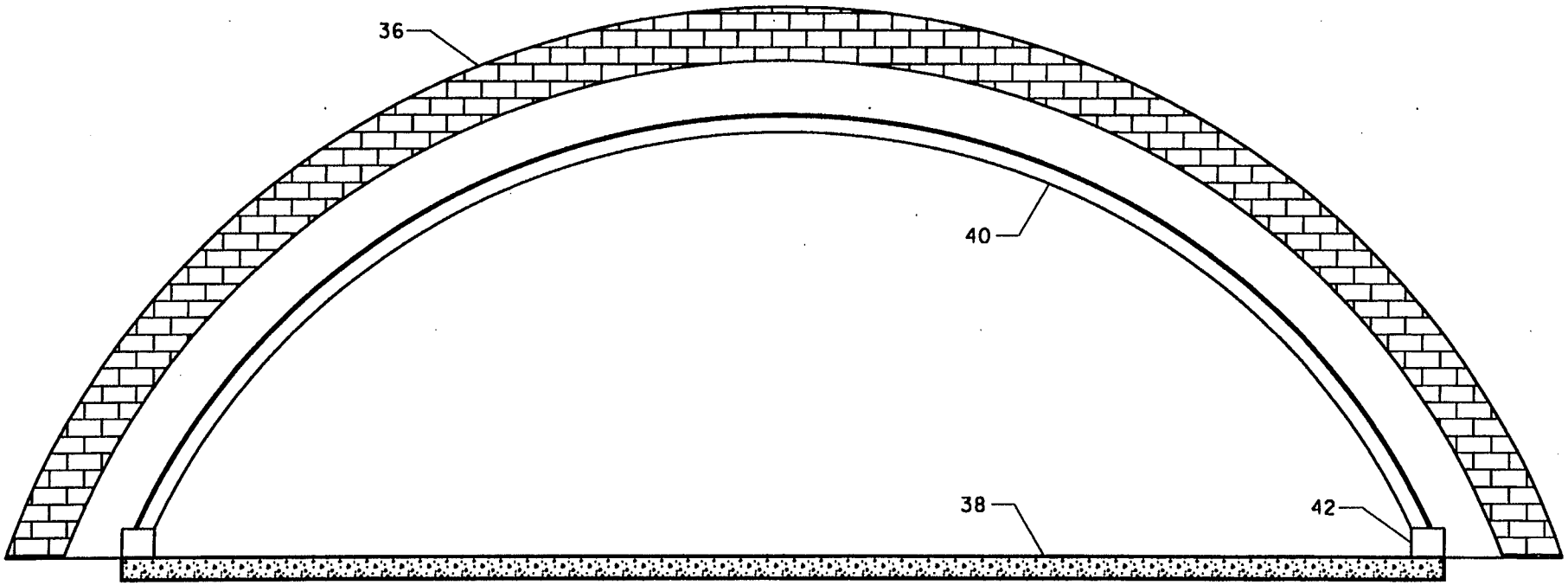
FIG. 3 is an end view illustrating the use of tunnel liners of this invention for lining a tunnel of arched-shaped section.
Figure 4:
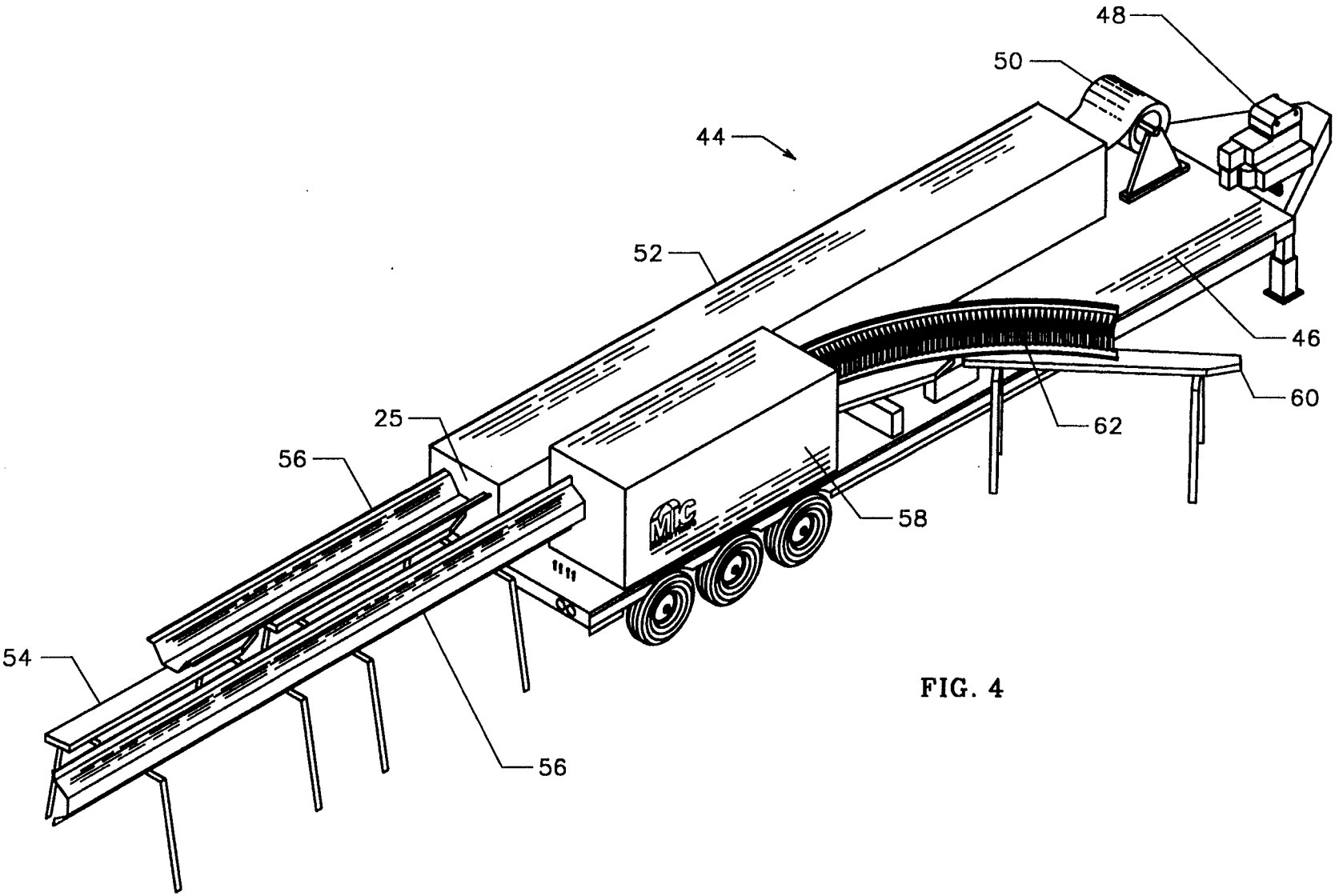
FIG. 4 is a perspective view of a panel forming and curving machine used for forming the panels of this invention.

This is shown, for example, in FIGS. 2 and 3. In FIG. 2, tunnel walls 32 are generally rectangularly shaped over a roadway 38. A plurality of assembled curved seamed panels form a tunnel liner 40. Seaming can take place on the underside or inside of the tunnel liner and the tunnel liner can be placed in a suitable foundation 42 to provide a completely self-supporting liner. As can be seen from FIG. 3, a similar situation obtains, because when the tunnel walls 36 are arch shaped, there is likely to be insufficient space on the topside of the top liner to accomplish the seaming.

The panel of this invention has equal cross sections on both sides of its center line to provide a more stable structure when completed. In other words, tension and compression forces acting within the panel are equal and opposite each other and provide a more balanced structure.

Existing tunnel liners provide adequate protection only for a limited amount of time, but with the present invention, the life of the tunnel liner is limited only by the life of the metal used which, of course, could be stainless steel, galvanized steel, aluminum, or the like. Additionally, lights or other elements can be connected to the inside of the tunnel liner by being seamed into the seam.

A preferred method of assembly is to accomplish the seaming of two or three panels as they lay on their side on the ground. Thereafter the panels are uprighted and adjoined to another section of previously seamed and uprighted panels by the seamer, which can be operated by an operator moving with a man-lift device to let the operator follow the arch from one end to the other. This provide a water-tight seal so that any moisture or weather environments from inside the tunnel structure travel along the outside of the tunnel liner to an appropriate drainage system. When finally completed, the tunnel liner provides an adequate surface in which lights and other fixtures can be applied underneath, with sheet metal screws if desired through the underturned flange assembly. Because the underturned flange assembly is not exposed to the environment, no leakage would come through the screw holes. In other words, the seam does not provide a leak path.

In erecting a series of three seamed-together panels, they are uprighted from a ground position to an erected position by a crane device which is attached to the underside of the panels. Once uprighted, the panels may be tied into position with ropes until enough panels are assembled that they become self-supporting. The process continuous in groups of three panels until the structure is completed. Assembling in groups of three gives the tunnel liner the ability to approach curves and tunnels, such as car tunnels, which may have curved portions. The design of this invention, allows the panels to be curved so as to make gradual turns within a tunnel.

Although this invention has been described with a degree of particularity in regard to the preferred embodiments, it is understood that this is only by way of example, and changes in detail structure may be made without departing from the spirit of the invention. It is the intention, therefore, to be limited only by the scope of the appended claims.

I claim:

1. A tunnel liner structure comprising:

(a) a plurality of arched continuously curved panels positioned side by side;

(b) each of the panels being constructed of bendable sheet metal material and having a central main portion, a pair of inclined side wall portions, one side wall portion on each end of and connected to the main portion and extending at a angle to the plane of the main portion, a pair of wing portions connected to the inclined side wall portions and extending outwardly therefrom in a plane generally parallel to the main portion, a hook portion extending from the end of one wing portion, and a receptacle portion extending from the end of the other wing portion, the receptacle portion being shaped be complementary to the hook portion to receive the hook portion therein, the receptacle portion also having an edge section at an outer end thereof; and (c) continuous seams between the plurality of adjacent panels, the seams formed by the edge portion of each panel being bent over the hook portion of an adjacent panel on the inside of the panels when assembled.

2. A tunnel liner structure as in claim 1 wherein the hook portion includes an inclined section and an end section, the end section being parallel to the main and wing portions.

3. A tunnel liner structure as in claim 2 wherein the receptacle portion includes an intermediate inclined section parallel to the inclined section of the hook portion and of substantially the same length, and an intermediate section connected to the inclined section and parallel to the end section of the hook portion, the intermediate section being connected to the edge section.

4. A tunnel liner structure including a plurality of arched continuously curved panels, each panel comprising:

(a) a central main portion;

(b) a pair of inclined side wall portions, one on each side of and connected to the central main portion and extending at an inclined angle to the plane of the main portion;

(c) a hook portion extending from one of the side wall portions of each panel; and (d) a receptacle portion extending from the other side wall portion of each panel, the receptacle portion opening in an upward direction away from said main portion and being complementarily shaped to receive the hook portion, the receptacle portion also having an edge section at the end thereof;

(e) each panel having equal cross-sectional areas on each side of a center of the main portion.

5. A tunnel liner structure as defined in claim 4 further comprising a pair of wing portions connected to the inclined side wall portions and extending outwardly therefrom in a plane generally parallel to the main portion, the wing portions having the hook and receptacle portions extending therefrom.

6. A tunnel liner structure as defined in claim 5 wherein the hook portion includes an inclined section and an end section, the end section being parallel to the main and wing sections; and wherein the receptacle portion includes an intermediate inclined section parallel to the inclined section hook portion of substantially the same length, and a central section connected to the inclined section parallel to the end section of the hook portion, the central section being connected to the edge section, the entire panel having equal cross sections on each side of the center of the main central portion.

7. A method of constructing tunnel liners of arched continuously curved shaped panels of bendable sheet metal material, the method comprising the steps of:

(a) forming a plurality of curved arched panels of bendable sheet metal material, each panel having a central portion, a pair of inclined sides with a hook on one side and a complementary receptacle with an edge section on the other side;

(b) assembling the panels in side-by-side relationship with the hook side of one panel adjacent and fitted into the receptacle side of adjacent panels; and (c) seaming sides of adjacent panels by bending the edge on the receptacle of one panel over the hook on the adjacent panel to form a continuous seam on the inside of the assembly of assembled panels when the panels are positioned as an arch.

8. A method as in claim 7 with steps including a plurality of the panels assembled side-by-side on the ground and seamed together, erecting the plurality of seamed together panels adjacent a similar plurality of seamed together panels, and then seaming the edges of the assemblies of the two pluralities of seamed together panels.

* * * * *

UNITED STATES PATENT AND TRADEMARK OFFICE

CERTIFICATE OF CORRECTION

PATENT NO. : 5,393,173

DATED : February 28, 1995

INVENTOR(S) : Frederick Morello

It is certified that error appears in the above-identified patent and that said Letters Patent is hereby corrected as shown below:

On the cover, Item [75], the inventor's town should be changed from "Johnston" to --Johnstown--.

Col. 3, line 46, "provide" should be --provides--.

Col. 4, line 25, delete "be".

Signed and Sealed this

Thirtieth Day of May, 1995

Bruce Lehman

*Attest:*

BRUCE LEHMAN

*Attesting Officer*

*Commissioner of Patents and Trademarks*